United States Patent [19]

Anderson

[11] Patent Number: 4,683,614

[45] Date of Patent: Aug. 4, 1987

[54] SLIDE HINGE

[75] Inventor: John P. Anderson, Norco, Calif.

[73] Assignee: Hartwell Corporation, Placentia, Calif.

[21] Appl. No.: 821,389

[22] Filed: Jan. 22, 1986

[51] Int. Cl.[4] ..... E05D 7/10

[52] U.S. Cl. ..... 16/362

[58] Field of Search ..... 16/362, 355, 352, 353

[56] References Cited

U.S. PATENT DOCUMENTS

| | | | |
|---|---|---|---|
| 47,092 | 4/1865 | Dailey | 16/355 |
| 819,098 | 5/1906 | Underhill | 16/355 |
| 1,128,620 | 2/1915 | Munzner | 16/363 |
| 1,994,021 | 3/1935 | Heller | 16/352 |
| 2,056,805 | 10/1936 | Reichard | 16/355 |
| 4,247,065 | 1/1981 | Grob et al. | 16/362 |

*Primary Examiner*—M. Jordan

*Attorney, Agent, or Firm*—Lyon & Lyon

[57] ABSTRACT

A slide hinge for pivotally mounting two bodies includes a curved channel disposed in a housing and a beam member slideably disposed in the channel. The housing is mounted to one of the bodies and the beam member is mounted to the other body. As the beam member slides in the channel, the hinged bodies pivot with respect to each other.

6 Claims, 10 Drawing Figures

SLIDE HINGE

BACKGROUND OF THE INVENTION

The field of the present invention is hinges for pivotally mounting doors.

Hinges are manufactured in many styles and shapes but are normally thought of as having two flat members connected together with a pin. In the motor home industry, the piano hinge and butt hinge have been used extensively on engine compartment doors, entry doors, and storage compartment doors. These hinges are inexpensive and very functional. Yet, because such hinges are designed more for utility than appearance, they may detract from the overall aesthetic appeal of the product. Thus, to make the product more attractive, other, more ornamental hinge designs are preferred. In the past hinges have been made as a decorative item or as an integral part of the door itself. In the latter case, the overall effect achieved is that of no visible hinge. Such hinges, however, while improving the appearance of the product, may not be durable. There is a need, therefore, for a hinge which is concealed and which is also rugged and durable enough to withstand prolonged use. Although such a hinge would generally be more expensive, it allows the manufacturer to upgrade his product in both appearance and value.

SUMMARY OF THE INVENTION

The present invention is directed to a hinge which is concealed when the hinged member or first body is in the closed position with the supporting member or second body.

A curved beam is provided that slides in a channel. A mounting flange is provided at one end of the beam for attachment to a hinged member. The channel is attached to the inside of the supporting member such as a wall or other fixed member about which the hinged member is to pivot. Movement (opening or closing) of the hinged member causes the beam to slide in the channel. As the curved beam slides in the channel, the hinged member pivots or rotates about a theoretical point located at the center of curvature of the curved beam.

Accordingly, it is an object of the present invention to provide a durable concealed hinge for use in applications where hidden hardware is desirable. Other advantages will be apparent from the ensuing detailed description of the preferred embodiment.

DETAILED DESCRIPTION OF THE PREFERRED EMBODIMENTS

Figure 1:
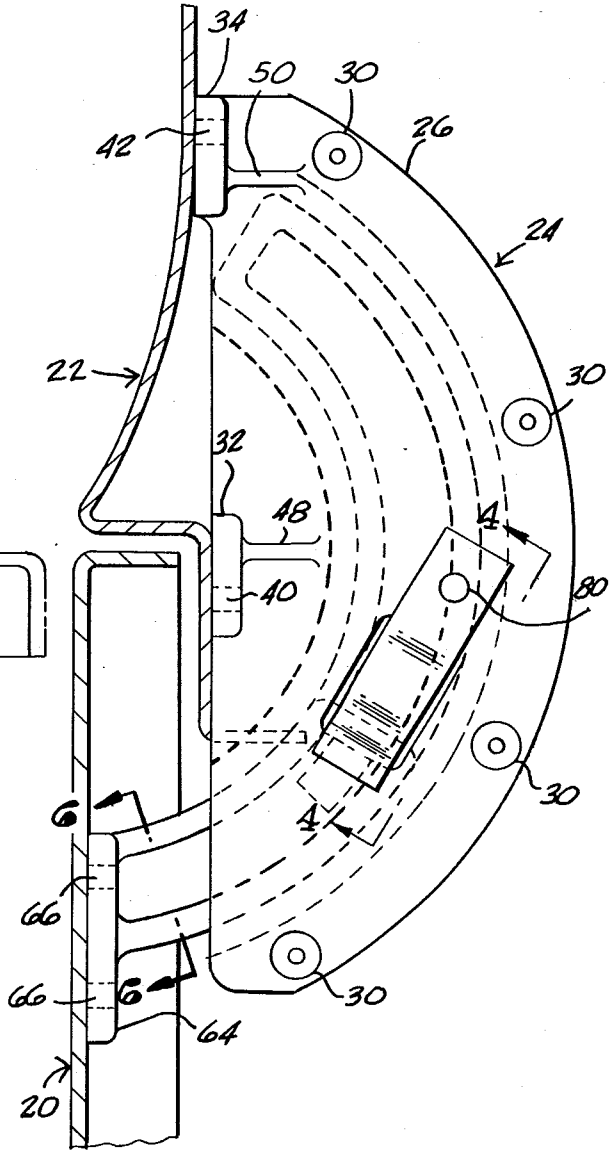
FIG. 1 is a plan view of a hinge assembly representing an embodiment of the present invention.
Figure 3:
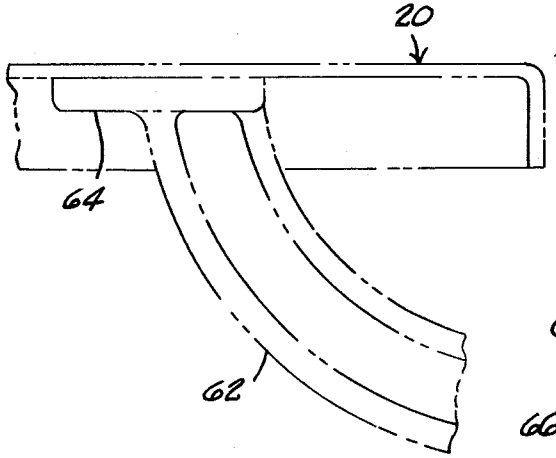
FIG. 3 is a sectional view taken along line 3—3 in FIG. 2.
Figure 2:
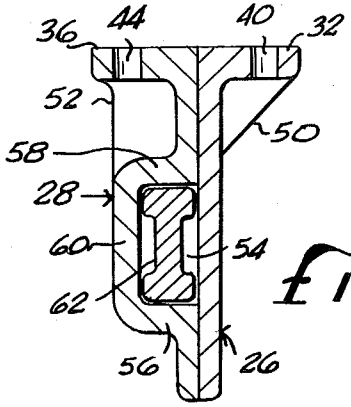
FIG. 2 is a side view of the hinge assembly depicting the base or mounting portion thereof.
Figure 2:
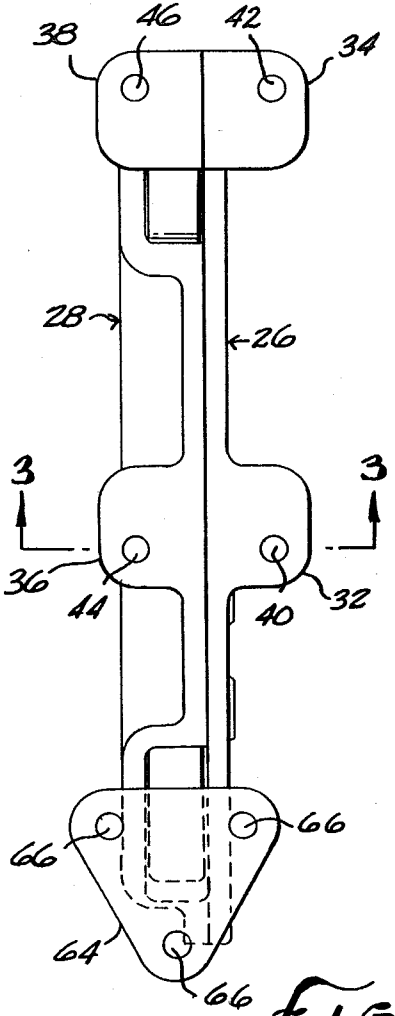

Referring to FIGS. 1, 2, and 3, a door panel 20 is pivotally mounted to a wall panel 22 by means of a hinge of the present invention. Mounted on the interior portion of the wall panel 22 is a housing assembly 24 comprising a cover plate 26 and a channel member 28. The channel member 28 and the cover plate 26 are mounted together at holes 30 in conventional fashion by screws, rivets or the like, rivets being utilized in the present embodiment. The housing 24 is attached to the wall panel 22 at four mounting surface locations, in this case tabs 32 and 34 on the cover plate 26 and tabs 36 and 38 on the channel member 28. Holes 40, 42, 44 and 46 are provided in the tabs to permit attachment by suitable fasteners such as screws, rivets or the like. To support the tabs, webs 48, 50 and 52 are provided.

The channel member 28 is configured to form a channel 54 defining a planar curve, in this case an arc. The channel 54 is formed by walls 56, 58 and 60 of the channel member 28.

Mounted on the inside portion of door panel 20 is a sliding beam member 62. A flange 64 is attached at the end of the beam to provide a mounting surface therefor. Located in the flange 64 are holes 66 to permit attachment of the beam member to the door panel 20 by suitable fastening means such as screws, rivets or the like.

Figure 8:
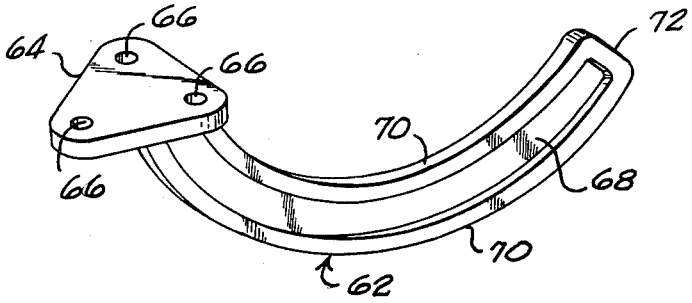
FIG. 8 is an orthographic view of a curved beam and attached mounting flange.
Figure 6:
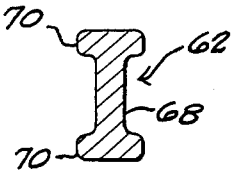
FIG. 6 is a sectional view taken along line 6—6 in FIG. 1.

Turning to FIGS. 6 and 8, the beam 62 is an I-beam comprising a web portion 68 and flange portions 70. At the end of the 62 opposite the mounting flange 64 is an end flange 72.

Figure 7:
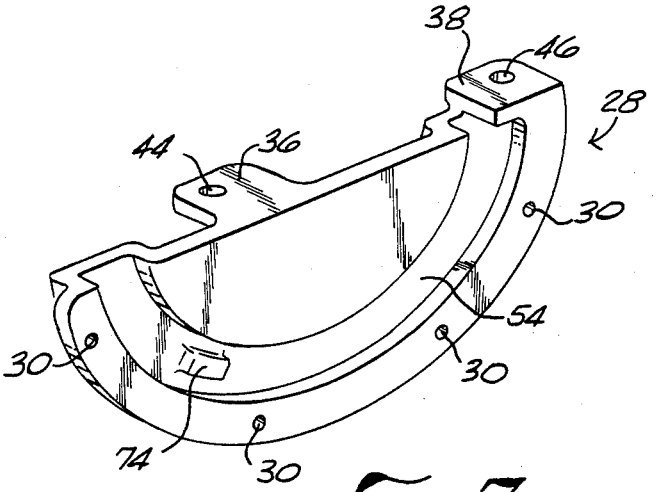
FIG. 7 is an orthographic view of a channel member.
Figure 9:
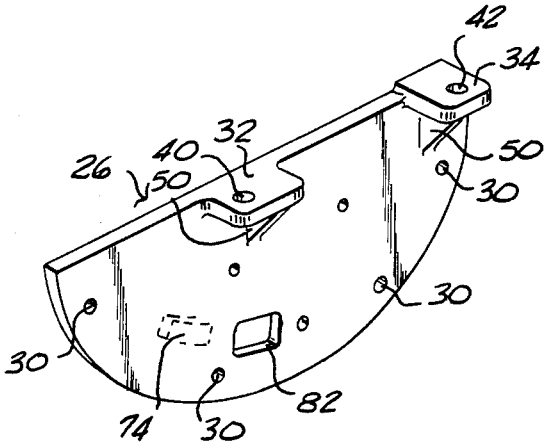
FIG. 9 is an orthographic view of a channel member cover plate.
Figure 10:
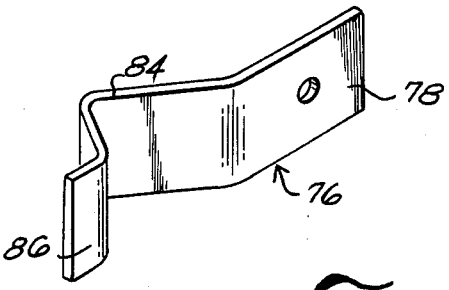
FIG. 10 is an orthographic view of a spring clip.

Referring to FIG. 1, when the door panel 20 is in the closed position, the beam member 62 extends substantially to the end of the channel 54. Beam ingress is limited by the tab 38 of the channel member 28 as shown in FIGS. 2 and 7. When the door panel 20 is pulled outwardly from the wall panel 22, the beam 62 slides through the channel 54 through a range of positions until the door panel 20 reaches a predetermined full open position depicted by phantom lines in FIG. 1.

Figure 4:
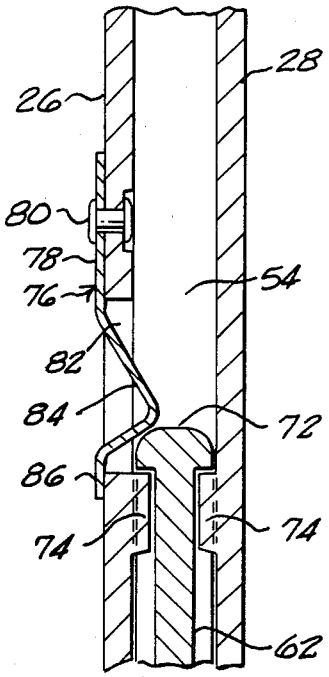
FIG. 4 is a sectional view taken along line 4—4 in FIG. 1.
Figure 5:
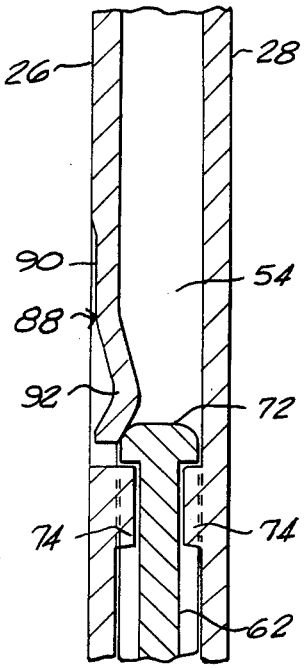
FIG. 5 is a sectional view taken along line 4—4 in FIG. 1 illustrating an alternate spring embodiment.

Turning to FIGS. 4 and 5, outward travel of beam 62 is limited by bosses 74 mounted on the cover plate 26 and the channel member 28. The bosses 74 extend into the recess areas on the side of the beam adjacent the web 68. When the beam slides to the open position, the end flange 72 comes in contact with the bosses, limiting further egress. This prevents the beam from being withdrawn completely from the channel and thereby limits the opening of the attached door or access panel to a predetermined distance. To retain the beam in this position, a spring clip 76 is provided. A first end portion 78 of the clip 76 is mounted to the cover plate 26 by means of a fastener 80, in this case a rivet. The clip extends through a window 82 in the plate 26 into the channel 54. A central portion 84 of the clip 76 angles into the channel and then curves back out, extending to the surface of the plate 26 where it meets a second end portion 86. The clip 76 is sized and angled to provide a lead-in or ramp effect. When sufficient closing force is applied to the beam, the clip deflects away from the beam until the flange 72 at the end of the beam has passed by. The spring clip 76 then returns to its undeflected position and rides in the recess area adjacent the web 68 of the beam where it offers no resistance to movement of the beam.

A second beam retention scheme is shown in FIG. 5. Rather than employing a spring clip 76, a tab 88 is integrally formed in cover plate 26. The tab 88 has a first end portion 90 and a second end portion 92 which extends through the window 82 in the plate 26 into the channel 54. The end portion 92 angles into the channel and then curves back out, away from the channel. The tab 88 is sized and shaped to provide spring action similar to that of the clip 76.

Thus, a slide hinge has been disclosed for pivotally mounting two bodies. While what has hereinbefore been described is the preferred embodiment of the present invention, it will be recognized that many variations are possible without departing from the spirit and scope of the invention as embodied in the claims hereinafter set forth.

What is claimed is:

1. A hinge for pivotally attaching two bodies, comprising a housing defining a channel therein, said channel defining a planar curve;

a curved beam slidably disposed in said channel, said curved beam having a flange at one end thereof and said housing including a boss positioned in said channel to engage said flange, said housing including a spring clip which engages said flange and urges same against said boss to retain said curved beam in a selected position;

mounting surfaces on said housing and said curved beam for mounting said housing and said curved beam to the bodies.

2. The device set forth in claim 1 further including means for limiting the travel of said curved beam in said channel.

3. The device set forth in claim 1 further including means for urging said curved beam to remain in a selected position in said channel.

4. The device set forth in claim 1 wherein said spring clip is formed from sheet metal.

5. The device set forth in claim 1 wherein said spring clip is integrally formed in said housing.

6. The device set forth in claim 1 wherein said curved beam comprises an I-beam.

* * * * *